US005172944A

United States Patent [19]

Munich et al.

[11] Patent Number: 5,172,944

[45] Date of Patent: Dec. 22, 1992

[54] MULTIPLE POINT CAM-PINION DOOR LATCH

[75] Inventors: Terry L. Munich, Isanti; Robert G. Lau, Anoka; Marc T. Fuller, Minneapolis; David A. Swan, Shoreview, all of Minn.

[73] Assignee: Federal-Hoffman, Inc., Anoka, Minn.

[21] Appl. No.: 800,051

[22] Filed: Nov. 27, 1991

[51] Int. Cl.[5] ..... E05C 3/10

[52] U.S. Cl. ..... 292/39; 292/51; 292/240

[58] Field of Search ..... 292/51, 240, 199, 39, 292/53

[56] References Cited

U.S. PATENT DOCUMENTS

| | | | |
|---|---|---|---|
| D. 292,171 | 10/1987 | Berg | D8/331 |
| 959,494 | 5/1910 | Fisher | 292/51 |
| 1,173,068 | 2/1916 | von Philp | 292/240 |
| 2,209,060 | 7/1940 | Lambert | 292/51 |
| 2,263,180 | 11/1941 | Lofgren | 292/51 |
| 3,088,548 | 5/1963 | Behrens et al. | 292/51 |
| 3,469,874 | 9/1969 | Mercurio | 292/51 |
| 4,631,937 | 12/1986 | Debus | 292/38 |
| 4,747,628 | 5/1988 | Goldman | 292/51 |
| 4,896,905 | 6/1990 | Lehr et al. | 292/39 |

FOREIGN PATENT DOCUMENTS

| | | | |
|---|---|---|---|
| 1102003 | 3/1961 | Fed. Rep. of Germany | 292/51 |
| 1931115 | 12/1970 | Fed. Rep. of Germany | 292/199 |
| 2116775 | 7/1972 | France | 292/199 |
| 1910 | of 1914 | United Kingdom | 292/51 |

OTHER PUBLICATIONS

Sarel U.K. Catalogue, 1991-1992, pp. 87-105.
Himmel Brochure, 1990.
Foreign brochure showing the Lume cabinet system-Lume 1989 Catalog.
Installation diagram from a Siemens Bulletin No. SIB2-.7-1B, 1989.
Instruction sheet for the Square-D cabinet latch system, No. 30072-303-30-F.
Cutler-Hammer publication No. 20322, Jan., 1989, pp. 1-4.
EMKA Brochure.
Sarel Spacial 6000—foreign brochure.

*Primary Examiner*—Eric K. Nicholson
*Attorney, Agent, or Firm*—Schroeder & Siegfried

[57] ABSTRACT

A multiple point latching system, for use with single or multi-door enclosures, which utilizes a plurality of combinational cam-pinion latch members which are rotatably mounted to the inside surface of the door and simultaneously driven by an elongated rack which extends between such latches and disconnectedly inter-engages therewith. Each combinational cam-pinion latch includes a plurality of teeth which disconnectedly inter-engage with apertures in the rack to cause simultaneous rotation thereof. A handle which is connected to the door and accessible from the exterior thereof drives one of the latch members which in turn causes movement of the rack and consequent rotation of all other combinational cam-pinion latches. Such latches are rotatably mounted at spaced locations along the free peripheral portions of the enclosure door. Each latch has a camming surface which engages the enclosure and draws the door into tightly sealed relation therewith upon closure of the door and movement of the handle to cause such latches to simultaneously move into their latched position. All cam-pinion latches and other associated latching hardware is mounted on the door in such a position that it is outside the sealed gasketed interior of the enclosure when closed and latched thereto, with no portions thereof protruding through the body of the enclosure to create possible leakage problems therein.

26 Claims, 8 Drawing Sheets

178
188
76
78
76
76
163
176
76
174
76
172
76
163
76
76
76
163

140
76
168
140
170
178
76
76
191
163
140
140
191
76
172
176
174
188
188
16
188
12
170
78

MULTIPLE POINT CAM-PINION DOOR LATCH

BACKGROUND OF THE INVENTION

The present invention is related generally to latching systems for enclosure doors, and is more particularly related to an improved multiple latch system for use with single door or multi-door enclosures.

Conventional enclosures have heretofore utilized various multiple latch systems to secure the doors thereof into tightly sealed relation therewith. Such systems often include a central door latch which has connected thereto one or more elongated extension rods that extend toward opposite upper and lower ends of the door. Such extension rods are usually designed to engage strikes which are mounted on the enclosure to cause the top and bottom ends of the door to be drawn against the enclosure in sealed relation therewith.

Although such systems have been somewhat effective in latching the door to the enclosure, leakage problems are prevalent due to the mounting of the strikes upon enclosure. Mounting of the strikes commonly involves piercing the body of the enclosure which creates a passageway for air leakage into the sealed interior thereof. Leakage problems also occur due to the fact that the enclosure door is only secured at the very top, bottom and middle of the door. For larger doors, the space between latching points increases and thus the potential for leakage therebetween increases.

Other multiple latch systems utilize a plurality of rotating latch members which are mounted to the door and fixedly interconnected to cause simultaneous rotation and latching of the door to the enclosure. Such latching systems generally include an elongated latch bar which is fixedly secured to each latching member in order to drive same. Such systems require numerous additional parts for inter-connecting such latch members, and require tedious and cumbersome labor during assembly thereof. For the foregoing reasons, such systems have proved to be impractical and costly. Moreover, such multiple latch systems usually involve mounting of each separate rotating latch assembly to the door via a bolt which penetrates the door and creates potential undesirable leakage points into the sealed interior of the enclosure.

It is evident from the above that it would be desirable to provide a multiple point latching system for enclosure doors which can accommodate any number of desired latches and can be easily assembled with minimal parts and labor, so as to reduce the effective cost and required repairs thereof. Such a system must accomplish the above while also being carefully constructed to avoid penetrating the enclosure body with the various necessary parts of the latch system, to avoid potential leakage paths into the sealed interior thereof.

The present invention solves each of the above problems found to be inherent in conventional door latching systems. Numerous advantages are gained through the use of the new latch system disclosed and claimed herein, which will become more apparent from the following disclosure thereof.

BRIEF SUMMARY OF THE INVENTION

The present invention utilizes a plurality of combinational cam-pinion latch members which are rotatably mounted to the inside surface of an enclosure door and spaced along the free peripheral portions thereof. Each latch member is constructed as a pinion gear which disconnectedly inter-engages with an elongated drive means or rack rod that extends between and adjacent to all such latch members.

The rack rod has a plurality of apertures therein which mesh with the pinion teeth on each of the latch members. The rack rod is supported in inter-engaging relation with each latch member by means of a flange which protrudes inwardly from the inner surface of the door. The latch members are mounted closely adjacent to the flange, and the rack rod is disposed between the flange and latch members such that the teeth of each latch member meshes with the apertures of the rack rod. Because the rack rod is sandwiched between the latch members and the flange, the flange supports and holds the rack rod in disconnected but inter-engaging relation with the latch members. Contrary to conventional enclosures, no direct physical connection is necessary between the latch members and the rack rod which extends therebetween.

To control the rotation of such latch members between their respective latched and unlatched positions, an externally accessible controlling lever or handle is mounted on the door which connects directly to one of the latch members. Upon rotation of the handle, the latch member connected thereto is caused to rotate, which in turn causes the meshing rod to move. Consequently, movement of the rack rod causes simultaneous and synchronous rotation of all such latch members which inter-engage therewith.

In one embodiment of the invention, each latch member comprises a cam with a camming surface or ramp which engages the enclosure upon closure of the door and rotation of such latch members into their latched positions. Once the cammed surface of each latch member engages the enclosure, further rotation of such latch members causes the door to be drawn evenly and tightly into sealed relation with the enclosure The door is designed to extend over the opening-defining portions of the door such that all latch members and other various components of the latch system are positioned outside the sealed opening of the enclosure. Each latch member is disposed such that it engages an outward extending flange of the enclosure, thereby avoiding the need to latch against a surface which is within the sealed interior of the enclosure. As such, no leakage problems occur due to the mounting of the various components of the latching system.

In a second embodiment, the enclosure assembly carries a plurality of external mounting blocks which facilitate mounting of the various wall panels of the enclosure to the enclosure body or frame solely from the exterior. In this case, the mounting blocks may either serve as catches for the cam-pinion latches of the door latch system, or may be designed with the necessary clearance so as to allow the cam-pinion latches to engage the enclosure body, as previously described As a result of the above-described unique construction of a multiple point combinational cam-pinion door latching system, fewer parts are necessary, and assembly time and cost are markedly reduced The unique construction of our new latching system requires no additional parts to fixedly connect the multiple latching members together, thus reducing the number of mechanical parts, and the frequency of eventual required repairs thereof.

BRIEF DESCRIPTION OF THE DRAWINGS

These and other objects and advantages of the invention will more fully appear from the following description, which is made in connection with the accompanying drawings, wherein like reference characters refer to the same or similar parts throughout the several views, and in which.

DETAILED DESCRIPTION OF THE INVENTION

Figure 1:
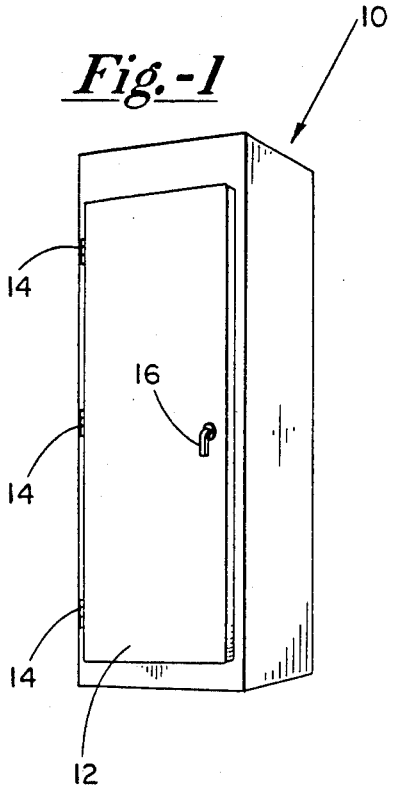
FIG. 1 shows a typical enclosure having a pivotal door which embodies the new multiple point cam-pinion latch systems.

As shown in FIG. 1, the multiple point cam-pinion latch system shown and described herein is commonly used with enclosures which require proper sealing thereof, such as electrical enclosures configured from steel, aluminum or other metallic material. As discussed above, it is often a concern with such enclosures that there be minimal leakage paths from the exterior to the interior of the enclosure. Thus, it is advantageous to seal the door against the enclosure at multiple points around the periphery of the door.

Enclosure 10 generally has a door 12 which is pivotal between an open and closed position via its hinged connection 14 to enclosure 10. Lever or handle 16 connects to the door 12 of enclosure 10 and is accessible from the exterior to control the latching and unlatching of the multiple point cam-pinion latch system which is positioned and mounted on the inside surface of door 12.

Figure 2:
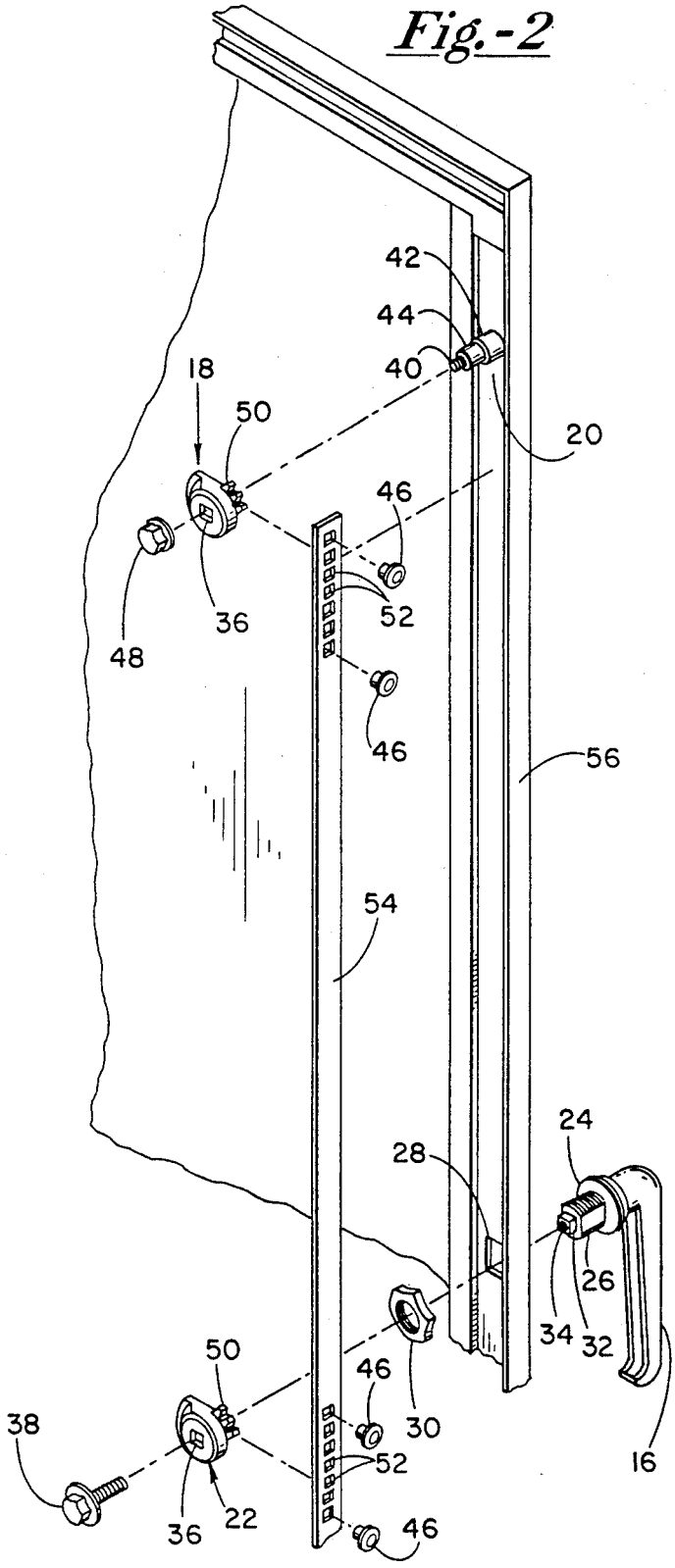
FIG. 2 is a fragmentary exploded view of the door of the enclosure shown in FIG. 1, showing the construction of the multiple point cam-pinion latch system, the lower portion of the door and latch system being constructed identical to the top portion.

As best shown in FIG. 2, the multiple point cam-pinion latch system is generally comprised of a plurality of identically constructed combinational cam-pinion latch members 18 which are mounted to the inside surface of door 12 in spaced relation to each other and adjacent the free peripheral portion 20 thereof. Such latch members 18 are simultaneously driven so as to cause even latching of the door 12 against the body of enclosure 10.

The central controlling latch member 22 connects to handle member 16 which is mounted to door 12 in pivotal relation thereto. More specifically, handle 16 has a body portion 24 with a threaded shaft 26 which cooperatively fits and extends through opening 28 in door 12. Nut 30 threads upon the threaded shaft 26 to securely connect the body 24 of handle 16 to the door 12. Handle 16, which has a terminal square-shaped lug portion 32, is rotatably carried within body portion 24, and extends therethrough. Controlling latch member 22 has a square-shaped aperture 36 which telescopically fits upon lug 32. Controlling latch member 22 is fixedly secured to lug 32 and handle 16 via a hex screw 38 which is threadably received within threaded axial bore 34 in lug 32. By mounting controlling latch member 22 to handle 16 in the manner described above, controlling latch member 22 can be driven and controlled via rotational movement of handle 16, which is accessible from the exterior of enclosure 10.

Each of the remaining combinational cam-pinion latch members 18 are pivotally mounted to a respective stud 40 which is welded to the inside surface of door 12 at various spaced locations adjacent the free peripheral portion 20 thereof. Each stud 40 is threaded at its free end and constructed with an annular collar 42 thereround. Each collar 42 has an axially protruding annular lug 44 which is of smaller cross-sectional dimensions than the major portion of collar 42, and is designed to be telescopically inserted into an aperture 36 of an adjoining latch member 18. As such, each latch member 18 (with the exception of controlling latch member 22) is rotatably carried on lug 44 of collar 42 of an associated stud 40. Each latch member 18 is secured upon its associated stud 40 via a flanged hex nut 48, which threads upon the terminal portion thereof.

Figure 10:
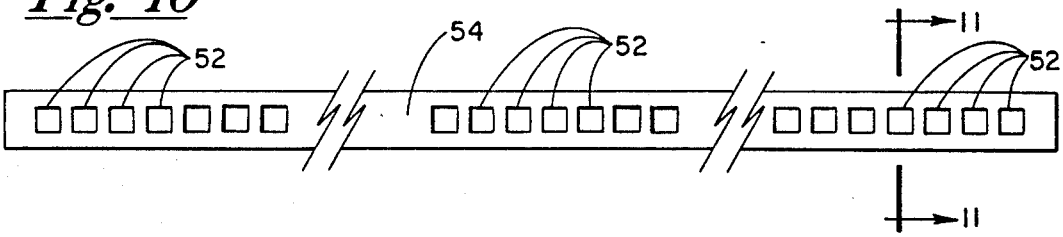
FIG. 10 is a fragmentary view of the elongated driving rack rod which disconnectedly inter-engages with each cam-pinion latch member to drive the same.
Figure 11:
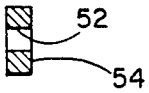
FIG. 11 is a vertical sectional view taken along lines 11—11 of the driving rack rod shown in FIG. 10.

Each latch member 18, (including the controlling latch member 22) constitutes a pinion with a plurality of teeth 50 which are designed to disconnectedly inter-engage with apertures 52 in an elongated driving rack rod 54. As is best seen in FIGS. 10 and 11, the apertures 52 are centered and spaced along the length of rack rod 54 such that the teeth 50 of each latch member 18 will cooperatively inter-engage therewith.

Door 12 has an inwardly extending peripheral flange 56 which supports rack rod 54 in disconnected but interlocked relation with each of the latch members 18 that are pivotally mounted upon the inside surface of door 12. Each latch member 18 is positioned and rotatably mounted upon the inside surface of door 12 such that rack rod 54 is sandwiched between the door flange 56 and each latch member 18, with the respective teeth 50 thereof extending into apertures 52. Glide buttons 46 are carried within apertures 52 of rack rod 54 to reduce the friction between flange 56 of door 12 and rack rod 54, as rack rod 54 moves vertically and drives the latch members 18 between their latched and unlatched position. As such, rack rod 54 is not required to be fixedly connected to each latch member, but remains supported in inter-engaging and driving relation therewith.

In its complete assembled state, the multiple point cam-pinion latch system is controlled from the exteriorally accessible handle 16, which drives the controlling latch member 22. In turn, controlling latch member 22 causes vertical movement in driving rack rod 54, which in turn causes simultaneous and synchronous pivotal movement of the remaining latch members 18.

It is conceivable, although not shown in the drawings, that such a multiple point cam-pinion latch system could be adapted to provide latching on the top and bottom free peripheral edges of the door 12, as well as edge portion 20 thereof. A similar rack rod and plurality of combinational cam-pinion latch members could be mounted on the top and bottom free peripheral edges of the door and interconnected with the existing latching system by means of a rotatable corner pinion or other bi-directional drive means for causing simultaneous movement of all drive rack rods.

As best shown in FIGS. 6–9, each combinational cam-pinion latch member includes a camming surface 58 which is designed to engage the body of the enclosure and draw the door 12 tightly thereagainst upon movement of lever 16 to cause such latch members 18 to rotate into their latching position. As can be best seen in FIGS. 6 and 8, the camming surface 58 ramps upwardly from a point 60 to a plateau or latching surface 62, which is higher than the remaining portion of the latch, as measured from the base 65 thereof.

Figure 3:
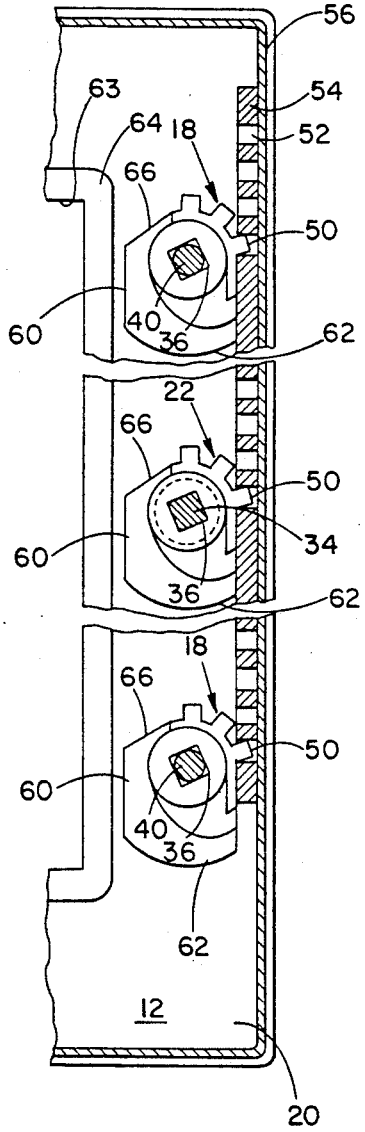
FIG. 3 is a fragmentary front vertical sectional view taken through the door of an enclosure similar to that shown in FIG. 1, wherein the multiple point cam-pinion latch system is shown in its unlatched position.
Figure 4:
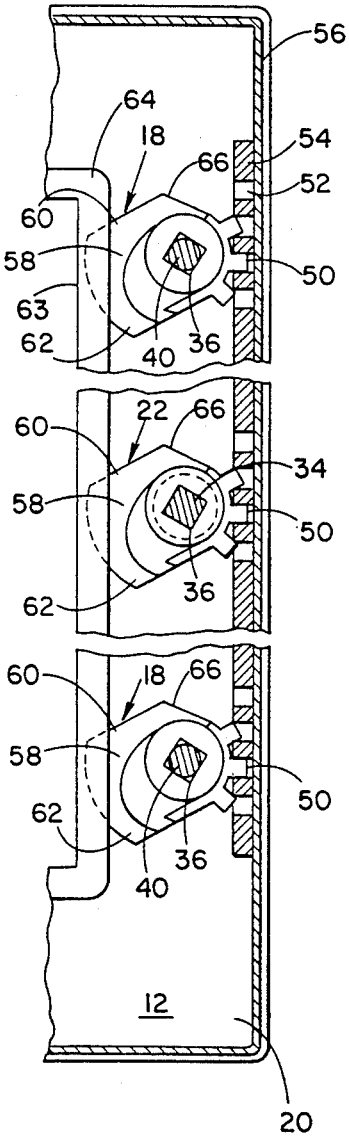
FIG. 4 is a fragmentary front vertical sectional view taken through the door of an enclosure similar to that shown in FIG. 1, wherein a multiple point cam-pinion latch system is shown in its partially latched state with each latch member simultaneously engaging the enclosure and drawing the door tightly thereagainst.
Figure 5:
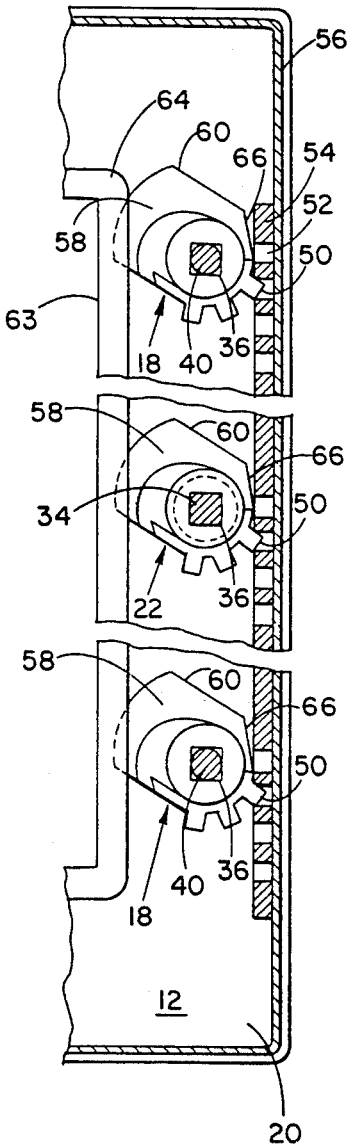
FIG. 5 is a fragmentary front vertical sectional view taken through the door of an enclosure similar to that shown in FIG. 1, showing the multiple point cam-pinion latch system in its fully latched position with all latch members simultaneously engaging the body of the enclosure so as to draw the door tightly thereagainst.
Figure 6:
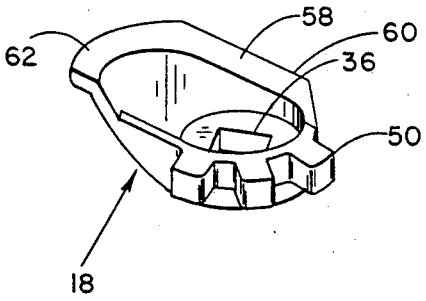
FIG. 6 is a perspective view of one of the combinational cam-pinion latch members, the remaining latch members being constructed identical thereto.
Figure 7:
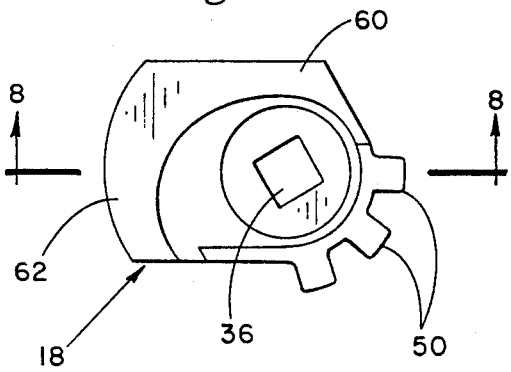
FIG. 7 is a top plan view of the combinational cam-pinion latch member shown in FIG. 6.
Figure 8:
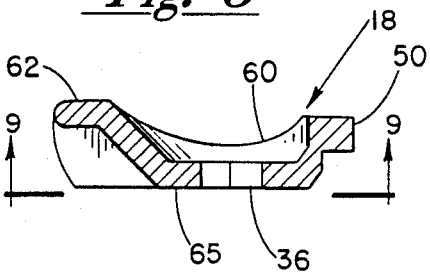
FIG. 8 is a sectional view taken along lines 8—8 of the combinational cam-pinion latch member shown in FIG. 7.
Figure 9:
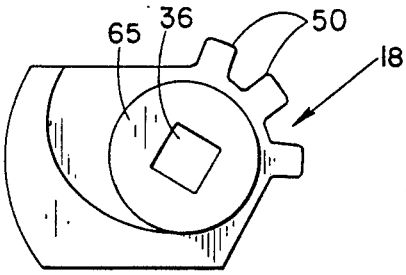
FIG. 9 is a bottom plan view of the combinational cam-pinion latch member shown in FIG. 6.

The operation of the multiple point cam-pinion latch system is best seen from FIGS. 3–5. The system shown in the above figures is a three-point latching system having three pivotal combination cam-pinion latch members 18 equally spaced and mounted adjacent the free peripheral portion 20 of door 12. It should be understood, however, that any number of such latch members 18 can be utilized for latching the door 12 evenly to the enclosure, depending on the desire of the manufacturer and the needs of the customer.

In FIGS. 3–5, the center latch constitutes the controlling latch member 22, which connects to handle 16 on the exterior surface of the door (not shown). FIG. 3 shows the multiple point cam-pinion latch system resting in an unlatched state, but with the door closed in such a position that rotation of handle 16 will cause each of the latch members 18 to pivot and latch against the enclosure. As can be seen in FIG. 3, at all times, the teeth 50 of each latch member 18 inter-engages with apertures 52 in driving rack rod 54. FIG. 3 also shows the inwardly extending door flange 56 supporting rack rod 54 in disconnected but inter-engaging relationship with each latch member 18. The inter-engagment of the teeth 50 of each latch member 18 with the apertures 52 of rack rod 54, and the support provided by the door flange 56, act to hold the rack rod 54 in an interlocked but disconnected position relative to the door 12 and latch members 18.

The enclosure 10 is constructed such that the door 12 overlaps the door opening-defining portions 63 thereof. Such opening-defining portions 63 of enclosure 10 includes a peripheral lip portion 64 which extends outwardly from the enclosure and bends away from the door opening toward the peripheral portions of enclosure 10. Lip portion 64 is designed to extend outwardly from the enclosure a distant sufficient to allow each latch member 18 to pivot such that its camming surface enters the space created between said lip portion 64 and the body of enclosure 10.

As shown in FIG. 4, as handle 16 is rotated, controlling latch member 22 also begins to rotate, thereby causing rack rod 54 to begin sliding vertically. Rack rod 54, in turn, via its disconnected inter-engagement with each latch member 18, causes simultaneous rotation of all such latch members 18. As each latch member 18 rotates, its respective camming surface 58 begins to rotate to a position between lip portion 64 and the body of enclosure 10. Upon such rotation, the underside of lip portion 64 is engaged by the camming surface 58 of each latch member 18, near point 60 thereof. Further rotation of such latch members 18 causes a camming action between the camming surface 58 of each latch member 18 and lip portion 64, thereby drawing the door 12 into even and tightly sealed relation with the body of enclosure 10.

Finally, as shown in FIG. 5, upon completion of the rotation of handle 16, each latch member 18 is rotated into its fully latched position where the latching surface 62 thereof bears against the underside of lip portion 64 so as to cause maximum drawing force of the door 12 against the body of enclosure 10. Each latch member 18 has a stop surface 66 which abuts rack rod 54 when each latch member 18 has rotated into its fully latched position, thereby preventing such latch members 18 from turning further.

Although FIGS. 3–5 disclose a plurality of such combinational cam-pinion latch members 18 positioned at spaced locations along the free peripheral portion 20 of door 12, it can be readily seen that, if necessary, such latch members 18 could also be mounted along the top and bottom peripheral edges of door 12. Such latching systems mounted along the various free peripheral edges of door 12 can be operated separately, or can include means for causing simultaneous movement and latching of all such latch members 18, thereby sealing the door 12 evenly against the body of enclosure 10 at all points around the door opening 63.

Because each latch member 18 and all other associated parts of the multiple point cam-pinion latch system are mounted to the door in such a position that they are disposed outside the sealed interior of the enclosure when the door is closed and latched, there is no potential for leakage from the exterior of the enclosure 10 into the interior thereof. Each latch member 18 is mounted on a pin 40, which is welded to the inside surface of the door. Moreover, the free peripheral portion 20 upon which each latch member 18 is mounted overlaps the opening-defining portions 63 of the enclosure so as to facilitate latching of each latch member 18 against the outwardly extending lip portion 64 of enclosure 10. As such, all portions of the latch system are disposed outwardly of the sealed interior of the enclosure and do not create any leakage problems therein.

Figure 12:
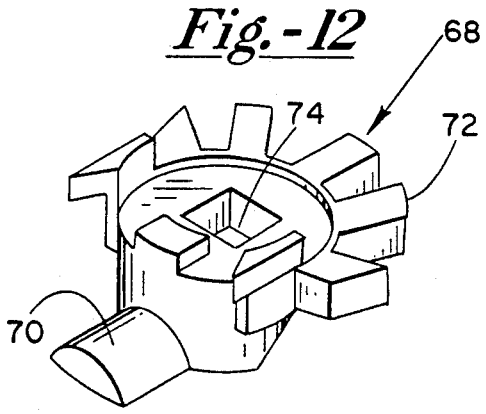
FIG. 12 is a perspective view of an alternative embodiment of our combinational cam-pinion latch.

Shown in FIG. 12 is an alternative embodiment of out combinational cam-pinion latch, designated as number 68. Similar to latch 18, each alternative latch 68 includes a camming surface 70 and a plurality of pinion teeth 72. Each alternative latch 68 includes a central aperture 74 which fits over and mounts upon an associated stud 40 in the identical manner as latch 18.

Figure 13:
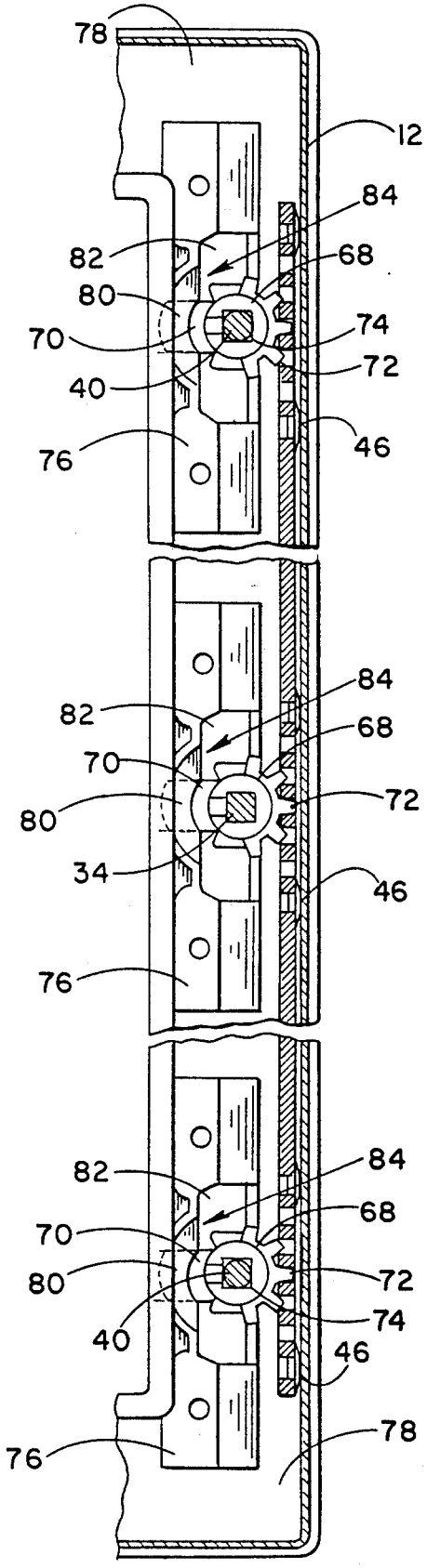
FIG. 13 is a framentary front vertical sectional view taken through the door of an enclosure similar to that shown in FIG. 1, showing our alternative multiple point cam-pinion latch system in its fully latched position with all alternative latch members simultaneously engaging external mounting blocks which are carried by the enclosure frame.

The construction and function of the alternative latch 68 is highly similar to latch 18, with the following exception. As shown in FIG. 13, latch 68 is designed for use with an enclosure system which has a plurality of external mounting blocks 76 mounted on the exterior surface of the enclosure frame 78. The construction and function of mounting blocks 76 are the subject of a copending patent application Ser. No. 07/799,547, entitled RESTRUCTURABLE ENCLOSURE WITH MULTI-PURPOSE MOUNTING BLOCKS, the contents of which are incorporated herein by reference thereto the essential matter of which is set forth immediately hereinbelow.

Figure 16:
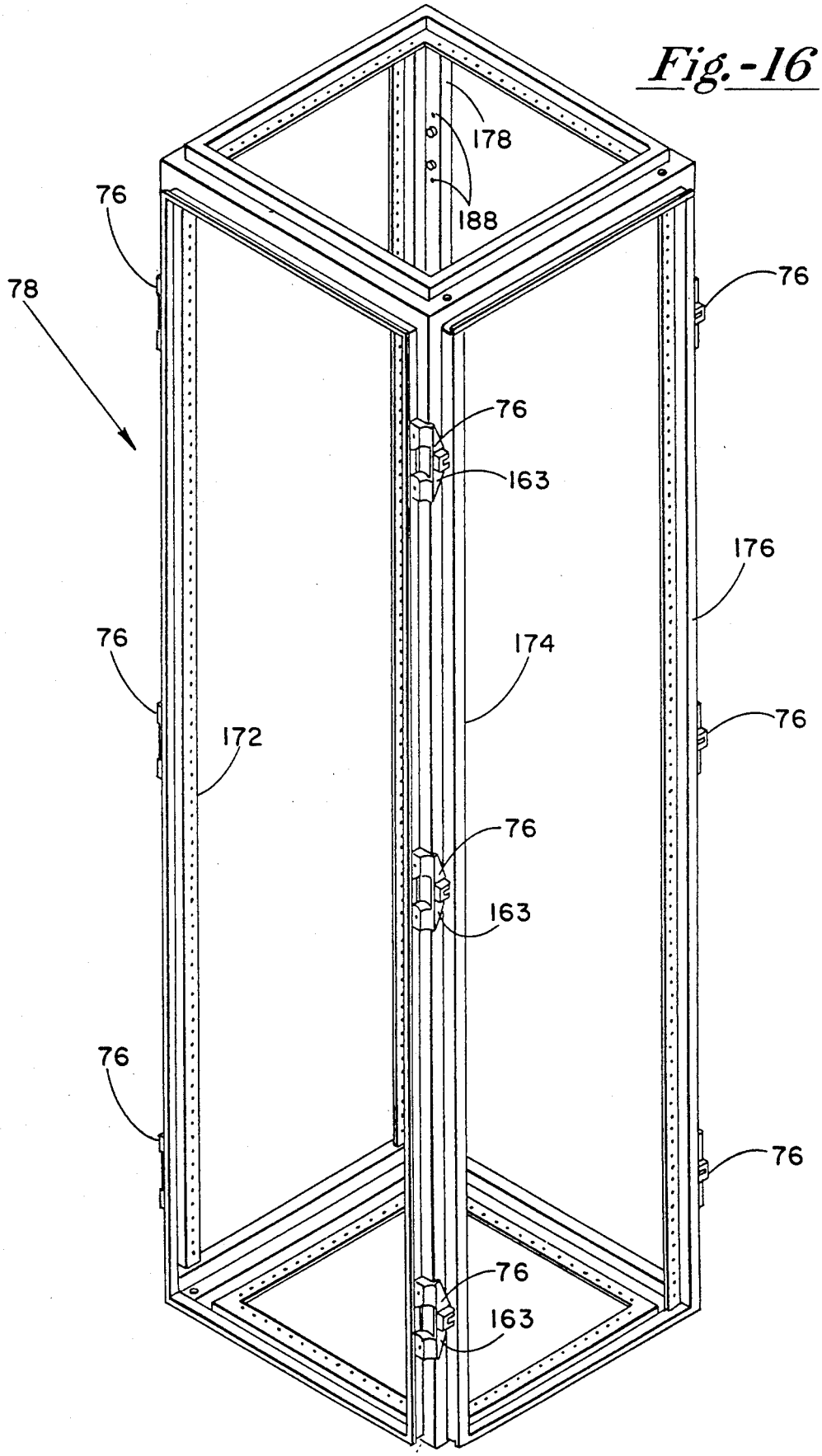
FIG. 16 is a perspective view of a modular enclosure frame assembly, showing a plurality of multi-purpose mounting blocks mounted thereon at spaced locations thereabout to provide for external connection of the various wall panels thereto.

As best shown in FIG. 16, each upstanding frame section 172, 174, 176, and 178 is constructed to receive and carry a plurality of mounting blocks 76, which are fixedly connected thereto at corresponding locations and elevations. Because all frame sections are identically constructed, each mounting block 76 is secured to its respective frame section in the same manner. For this reason, the specific manner in which each mounting block 76 is secured to a particular frame section will be described with reference to only one such block 76, as shown in FIG. 14.

Figure 14:
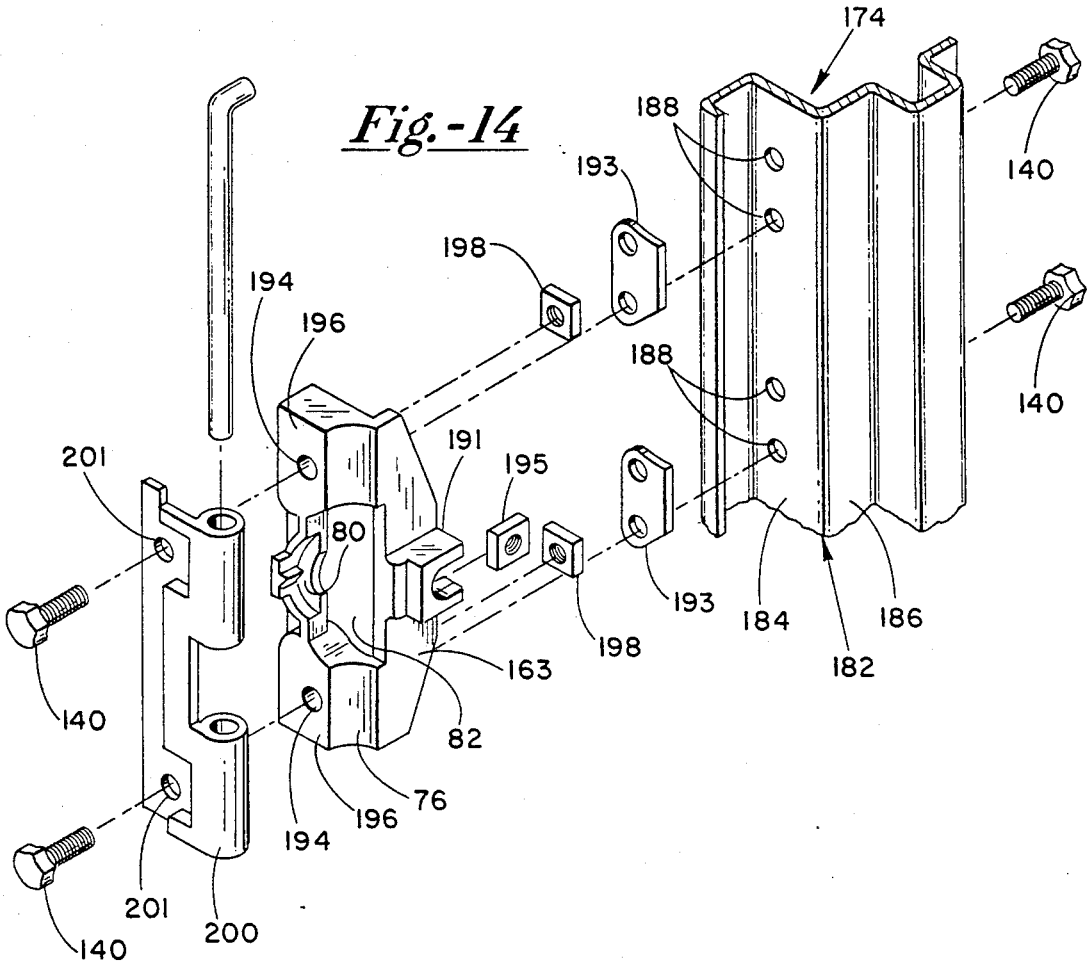
FIG. 14 is a fragmentary exploded perspective view of a multi-purpose mounting block which is utilized with restructurable enclosures for mounting of various wall panels thereto, and for providing a catch against which a combinational cam-pinion latch, such as that shown in FIG. 12, may securely engage.
Figure 19:
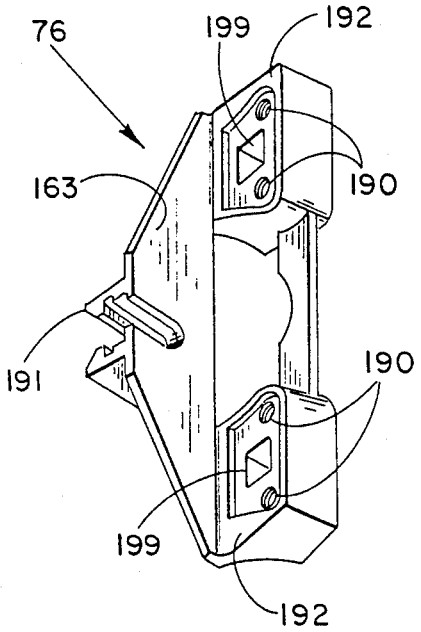
FIG. 19 is a rear perspective view of the multi-purpose mounting block shown in FIG. 18.
Figure 20:
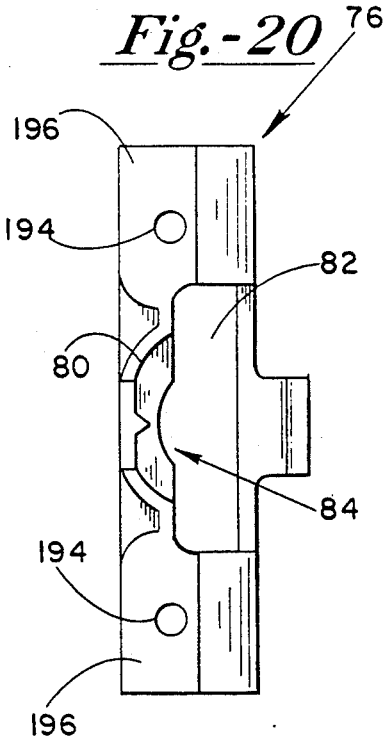
FIG. 20 is a top plan view of the multi-purpose mounting block shown in FIG. 18.
Figure 21:
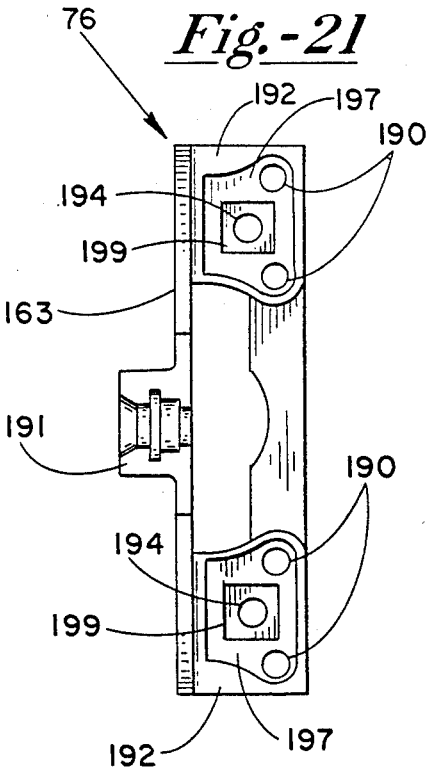
FIG. 21 is a bottom plan view of the multi-purpose mounting block shown in FIG. 18.

Shown in FIG. 14 is a portion of frame section 174, showing how such a mounting block 76 is secured thereto. Frame section 174 includes an angled corner flange 182, which has a forward facing surface 184 and a side facing surface 186. Forward surface 184 has a plurality of apertures 188 extending therethrough, which are spaced and positioned in predetermined locations for cooperative alignment with the threaded bores 190 in the base surface 192 of mounting block 76 (shown in FIGS. 19 and 21). As can be seen in FIG. 14, mounting block 76 is secured to frame section 174 via a pair of bolts 140, which extend through a pair of apertures 188, through gaskets 193 and into threaded bores 190 in the base surface 192 of mounting block 76. The remaining apertures 188 are disposed in communicating relation with the remaining bores 190 in mounting block 76, which facilitates mounting of internal racks and other assemblies. Because mounting blocks 76 are attached to the exterior of latticework 78, they provide mounts for the internal accessories without obstructing the interior of the enclosure.

Alternative mounting block 76 is characterized by an additional integral flange portion 163, which extends normal to base surface 192 in a direction away from mounting surface 196. Flange 163 of block 162 wraps around and rests against the side facing surface 186 of corner flange 182 when mounting block 76 is connected to frame section 174. As shown in FIG. 16, flange portion 163 is disposed such that it faces outwardly toward the side of the enclosure to provide for external mounting of a side panel 170 thereto.

It is noted that several sets of apertures 188, which facilitate connection of mounting blocks 76, are spaced along the length of each upstanding frame section, and are disposed in substantially identical predetermined locations thereon to enable cooperative interchangeability and reversibility of the various door and wall panels which connect to mounting blocks 76. As best shown in FIG. 16, each of the forward upstanding frame sections 172 and 174 include a plurality of mounting blocks 76 mounted at various predetermined spaced locations on the front surface portion 184 thereof. As stated previously, such mounting blocks 76 are mounted in cooperative relation, such that the door panel 12 may be externally mounted, removed and easily reverse mounted thereon for optional use as a right-handed or left-handed door.

Figure 17:
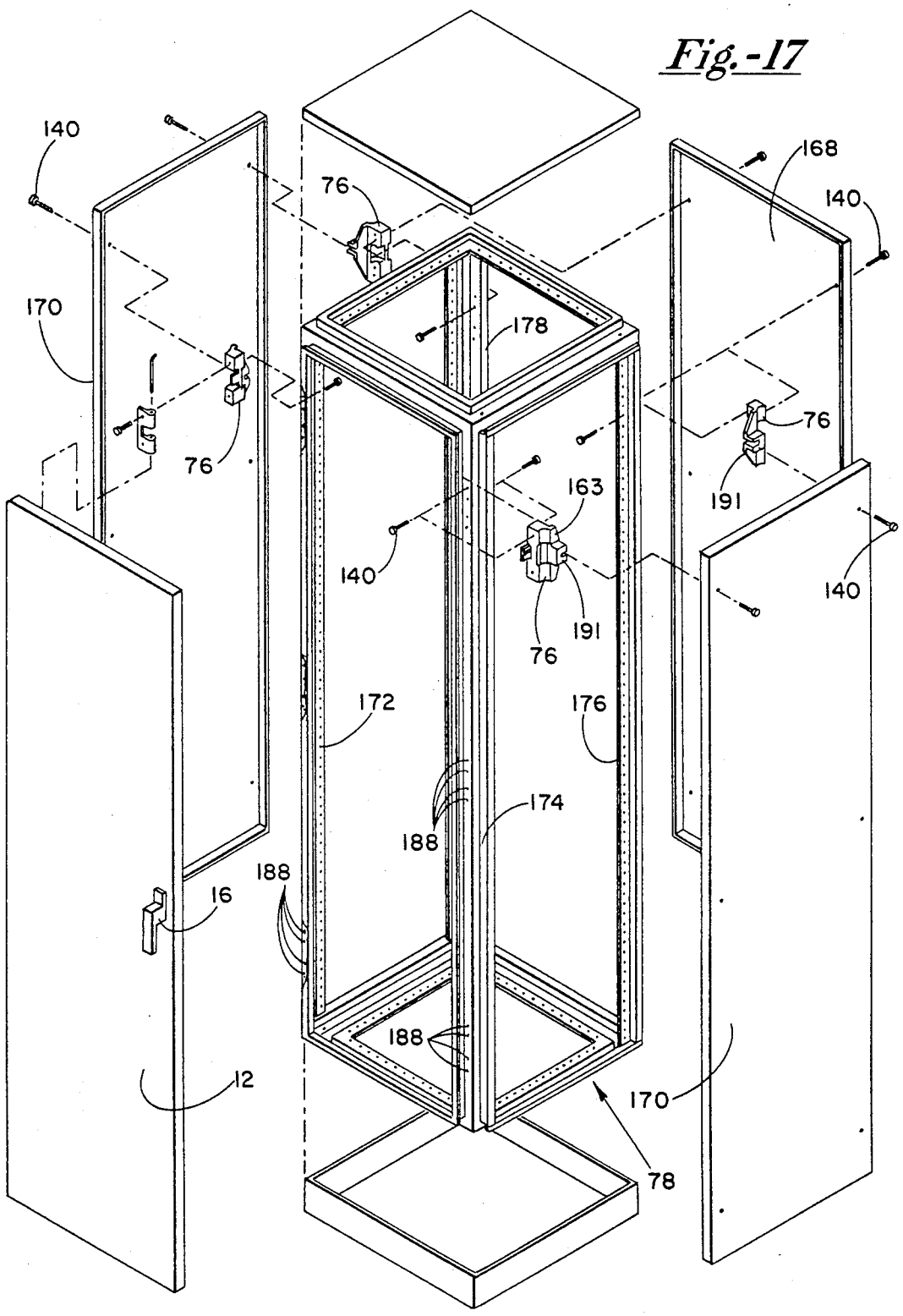
FIG. 17 is an exploded perspective view of a restructurable enclosure having removable front, rear and side panels, exemplifying the use and mounting of the multi-purpose mounting blocks at the uppermost portion of the enclosure, the lower blocks being mounted thereon in an identical manner, as shown in FIG. 16.
Figure 18:
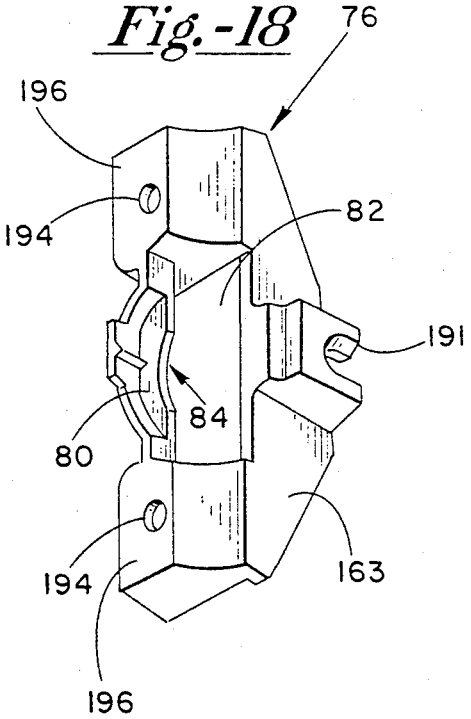
FIG. 18 is a front perspective view of a multi-purpose mounting block.

Due to the identical construction of all frame sections, rear vertical frame sections 176 and 178 also include an identical angled corner flange 182, which defines a rear surface (similar to front surface 184) and a side surface 186, upon which a plurality of such mounting blocks 76 may be secured in the same manner described above. As shown in FIGS. 16 and 17, such mounting blocks 76, which are secured to rear vertical frame sections 176 and 178, are mounted at the same elevation as those mounting blocks 76 which are mounted on front frame sections 172 and 174. Mounting such blocks 76 in substantially identical predetermined cooperative locations on vertical frame sections 172, 174, 176, and 178, provides versatility, interchangeability, and reversibility of the various wall panels of the enclosure.

With specific reference now being made to FIGS. 18-21, it can be seen that each alternative mounting block 76 includes a pair of spaced open bores 194 which extend through its body from its mounting surface 196 to its base 192. Bores 194 facilitate mounting of the front door and rear wall panels, 12 and 168, respectively, to the enclosure frame. The base surface 192 of each mounting block 76 includes a pair of substantially square openings 199, each of which aligns with a bore 194 and is designed to received and hold therein, in relatively loose fitting relation, a locking nut 198 (shown in FIG. 14). Recesses 197, which are formed at opposite ends of the base surface 192 of each mounting block 76, are designed to receive gaskets 193 therein. Gaskets 193 hold the respective nuts 198 within their associated openings 197 in each mounting block 76 when the same is secured to its respective frame section.

Gaskets 193 also function to perfect a seal between each mounting block 76 and the corresponding aligned apertures 188 in the enclosure frame on which it is mounted, thereby preventing leakage therethrough.

Figure 15:
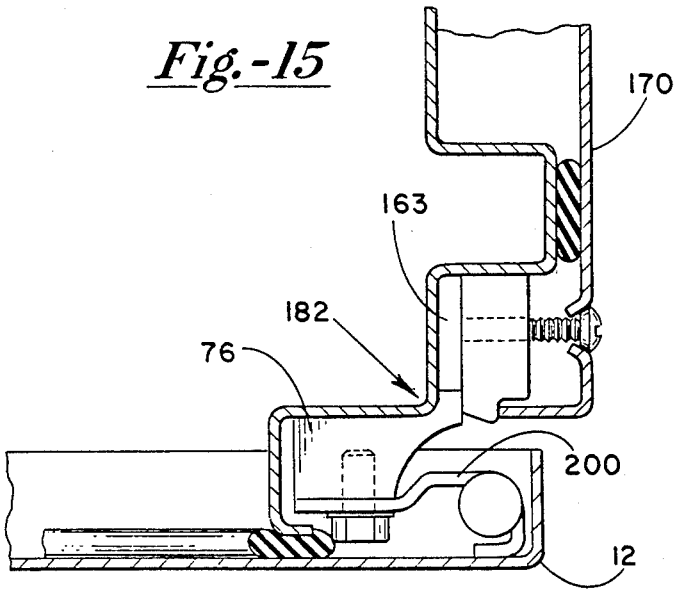
FIG. 15 is a cross-sectional view taken along a horizontal plane through an assembled restructurable enclosure similar to that shown exploded in FIG. 17, showing the external connection of an adjacent door and side panel to the mounting surfaces of one of the mounting blocks which are mounted on the enclosure frame.

As best shown in FIGS. 14 and 15, each of the mounting blocks 76, which are mounted upon identically configured upstanding structural members 172 and 174, are constructed such that a door hinge 200 may be mounted on the mounting surface 196 thereof via bolts 140. Bolts 140 extend through openings 201 in hinge 200, and into apertures 194 on opposite ends of each mounting block 76 to which they are mounted. Bolts 140 secure the hinges to the mounting blocks 76 by threading into nuts 198, which are fixed in loose but stationary position within the respective openings 199 in each mounting block 76. A door panel 12 may either be hinged to the mounting blocks 76 carried by structural number 172, or be reversed and mounted on the blocks 76 which are carried by structural member 174. Of course, a door panel may also be hingedly mounted to those blocks 76 which are carried by either of the rear structural members 176 or 178.

As stated previously, openings 199 in each mounting block 76 are slightly oversized to provide a floating, loose fit for the nuts 198 therewithin. Such a floating relation provides a built-in locational alignment tolerance between the blocks 76 and the various wall panels which are mounted thereon. This is important in the event that the enclosure frame is positioned on a slanted or uneven surface.

As shown in FIG. 17, the rear panel 168 of the modular enclosure externally mounts to latticework 78 in an identical manner to door 12, with the exception that hinge 200 is not used. Thus, rear panel 168 is connected to each of the mounting blocks 76 on rear frame sections 176 and 178 via a bolt 140, which extends through each opening 203 in rear panel 168, and into one of the apertures 194 in an aligned mounting block 76, where it can be threaded into, and secured by, a locking nut 198.

Side panels 170 externally mount to latticework 78 via the integral flange portions 163 of the various mounting blocks 76 that are connected to the frame. As seen best in FIGS. 19 and 21, flange portion 163 of each mounting block 76 includes a channeled portion 191 which is constructed to receive therein, in loose fitting relation, a securing nut 195 (shown in FIG. 14). Similar to nut 198, a bolt 140 may be threaded into nut 195 to secure a side panel 170 to the mounting block 76.

As shown in FIG. 13, a mounting block 76 is mounted to the enclosure frame 78 in a position directly adjacent to the position of each cam-pinion latch 68. Each mounting block 76 includes a bridge portion 80 which spans over a central recessed area 82, thereby creating a slot 84 therebetween. Upon closure of door 12 and rotation of handle 16, simultaneous rotation of all latch members 68 is effected, thereby causing the camming surface 70 of each latch member 68 to slide over the recessed area 82 of its adjacent mounting block 76 and under the bridge portion 80 thereof. As shown by phantom lines in FIG. 13, the camming surface 70 of each latch 68 enters slot 84 and bears against the underside of the bridge portion 80 of its associated block 76, thereby urging the door 12 into evenly and tightly sealed relation with the enclosure body. Rather than the cam-pinion latch locking to lip 64 of the enclosure, it now locks to an associated mounting block 76.

FIG. 13 is provided to show the locking function of alternative latch 68. Drawings have not been included to show the specific rotation pattern of latch 68 from an unlatched position to its final latched position, because the manner in which such rotation is effected is substantially identical to that shown in FIGS. 3 and 4. It is noted that rack rod 54 remains in disconnected but interengaging relation with each alternative latch 68, in the same manner as latch 18.

In considering this invention, of course, it will be understood that various changes may be made in the form, details, arrangements and proportions of the parts without departing from the scope of the invention which comprises the matter shown and described herein and set forth in the appended claims.

We claim:

1. An enclosure with a multiple point door latching assembly comprising:

(a) enclosure having opening-defining portions and a door pivotally mounted thereto, said door having top, bottom and side edges and being movable between open and closed positions, and said door having an inside and outside surface and an integral peripheral flange extending away from said inside surface along at least one of said side edges of said door, said inside surface being constructed and arranged to cover and seal against said opening-defining portions of said enclosure when closed;

(b) a plurality of latch members disposed exteriorally of said door, said latch members being rotatably mounted in spaced relation to each other along peripheral portions of said inside surface of said door adjacent said peripheral flange thereof, each of said latch members being movable between a latched and unlatched position;

(c) a drive means for causing simultaneous rotation of all said latch members between their said latched and unlatched positions upon rotation of one of said latch members, said drive means being disposed in abutting relation with said peripheral flange of said door and being constructed and arranged to be supported thereby in inter-engaging relation with each of said latch members;

(d) a lever disposed external to said enclosure and connected to one of said latch members to facilitate rotation of same between its said latched and unlatched position; and (e) each of said latch members including means for engaging said enclosure and drawing said door into tightly sealed relation therewith upon closure of said door and rotation of said lever, and said latch member connected thereto, into said latched position.

2. The structure defined in claim 1, wherein said enclosure-engaging means on each said latch member comprises a cammed latching surface which engages said opening defining portions of said enclosure and urges said door toward said enclosure when said door is closed and said latch members are rotated into said latching position.

3. The structure defined in claim 1, wherein said lever extends through an opening in said door to connect with one of said latch members, and the remaining said latch members are rotatably mounted to said inside surface of said door without penetration thereof.

4. The structure defined in claim 1, wherein each of said latch members comprise a pinion which interengages in movable relation with said drive means.

5. The structure defined in claim 1, wherein said latch member which is connected to said lever controls the movement of said drive means, and said drive means controls the movement of the remaining said latch members.

6. The structure defined in claim 1, wherein said drive means comprises a rack rod and each said latch member comprises a combination cam and pinion which interengages with said rack rod so as to facilitate synchronous rotation of all said latch members upon rotation of said lever and said latch member connected thereto, each of said latch members being constructed and arranged to cam against a portion of said enclosure in such manner as to draw said door into tightly sealed relation with said enclosure when said door is closed and said lever, and said latch member connected thereto, are rotated into said latching position.

7. The structure defined in claim 1, wherein said drive means comprises an elongated rod having a plurality of apertures therethrough, each of said latch members having a plurality of teeth which engage some of said apertures and mesh therewith to provide for simultaneous movement of all said latch members upon movement of said rod.

8. The structure defined in claim 1, wherein said latch members and said drive means are disposed along the peripheral portion of said door which is opposite said pivotal mount thereof.

9. The structure defined in claim 1, wherein said door has peripheral portions which are hingedly mounted to said enclosure, and free swinging peripheral portions along which said latch members are positioned.

10. The structure defined in claim 1, wherein said door seals against said opening-defining portions of said enclosure when closed, and said peripheral portions of said door upon which said latch members are mounted extend outwardly beyond said opening-defining portions such that said latch members are disposed entirely outside the sealed interior of said enclosure.

11. The structure defined in claim 1, wherein said opening-defining portions of said enclosure include an outwardly extending flange with a free end portion that bends away from said opening so as to provide a surface against which said latch members will lockably engage when said door is closed and said lever and said latch member connected thereto are rotated into said latching position.

12. The structure defined in claim 1, wherein the inter-engagement of said drive means and each of said latch members and the relative spacing between said peripheral door flange and said latch members causes said drive means to be supported in interlocked relation therebetween.

13. The structure defined in claim 1, wherein said enclosure includes a plurality of external mounting members connected thereto at spaced locations about the periphery of said opening-defining portions, each of said latch members being constructed and arranged to engage one of said mounting members in locking relation when said lever, and said latch member connected thereto, are rotated into said latching position.

14. A multiple point latching assembly for the door of an enclosure having a plurality of wall panels, comprising:

(a) a plurality of wall-panel mounting members connected to the enclosure at spaced locations thereabouts, each of said mounting members being constructed and arranged with the dual capability for mounting or latching of at least a door panel thereto, at least some of said mounting members pivotally supporting said door panel so as to be capable of moving said door panel between an open and closed position;

(b) a plurality of latch members rotatably mounted to said door panel, each of said latch members being movable between a latched and unlatched position and constructed and arranged to engage one of said mounting members in latching relation upon rotation thereof into said latched position after closure of said door panel, thereby drawing said door panel into tightly sealed relation with the enclosure;

(c) a drive means which is constructed and arranged to be supported between said latch members and said door panel in inter-engaging relation with each of said latch members, and to drive and cause simultaneous rotation of all said latch members between said latched and unlatched positions upon movement of said drive means; and (d) a control means disposed in engaging relation with said drive means for causing movement thereof and consequent movement of said latch members between their latched and unlatched positions, said control means being movably connected to said door panel and accessible from the exterior thereof.

15. The structure defined in claim 14, wherein said control means is comprised of a lever which is connected to one of said latch members for causing rotation thereof, said drive means being movably controlled by said latch member which is connected to said lever.

16. The structure defined in claim 15, wherein said drive means is comprised of an elongated rack rod which has apertures therein which disconnectedly inter-engage with teeth on each of said latch members.

17. The structure defined in claim 14, wherein each of said latch members is a cam having a camming surface which engages and draws the door toward the enclosure upon closure of the door and movement of said control means so as to cause each of said latch members to rotate into their latched position.

18. The structure defined in claim 14, wherein said drive means is supported in inter-engaging relation with each of said latch members by the door.

19. The structure defined in claim 14, wherein each of said latch members is a pinion having teeth which disconnectedly inter-engage with said drive means.

20. The structure defined in claim 14, wherein said control means is connected in controlling relation to one of said latch members, said latch member which is controlled by said control means being constructed and arranged to control the movement of said drive means, and said drive means being disposed in controlling relation to the remaining said latch members.

21. The structure defined in claim 20, wherein said control means comprises a rotatable lever mounted on the exterior of the door which causes rotation of said latch member connected thereto between its said latched and unlatched positions, each said latch member comprising a combined cam and pinion which inter-engages with said drive means and cams against the enclosure to draw the door thereto when the door is closed and said lever is rotated such that each of said latch members rotate into said latched position.

22. The structure defined in claim 21, wherein said drive means comprises a rack which inter-engages with said pinion latch members to cause synchronous movement thereof and simultaneous multi-point latching of the door to the enclosure.

23. A multiple point latching assembly for an enclosure door which is movable between an open and closed position, comprising:

(a) a plurality of latch members rotatably mounted to the door and movable between a latched and unlatched position, each of said latch members comprising a pinion gear with an integrally formed camming surface which is constructed and arranged to engage the enclosure upon rotation thereof to its latched position when the door is closed, thereby causing the door to be drawn into tightly sealed relation with the enclosure;

(b) a rack rod supported between each of said latch members and a peripheral edge door flange which is integrally formed with the door, said rack rod being disposed in inter-engaging relation with each of said latch members, and said pinion gear portion of each of said latch members cooperatively meshing with said rack rod such that movement of said rack rod causes simultaneous rotation of each of said latch members; and (c) a lever rotatably mounted to the door and disposed in controlling relation to said rack rod, said lever being constructed and arranged such that rotation of said lever causes movement of said rack rod and rotation of each of said latch members between its latched and unlatched positions.

24. The structure defined in claim 14, wherein each of said wall-panel mounting members is constructed and arranged to facilitate mounting of a plurality of enclosure wall panels thereto.

25. The structure defined in claim 14, wherein a first set of said mounting members provide means for pivotally mounting said door panel to the enclosure, and a second set of said mounting members provide a catch means for said plurality of latch members which are mounted on said door panel, said door panel being reversible and pivotally mountable upon said second set of said mounting members, thereby facilitating latchable engagement of each of said latch members with one of said mounting members of said first set of mounting members.

26. The structure defined in claim 14, wherein each of said latch members comprise a pinion gear with an integrally formed camming latch surface.

* * * * *